United States Patent [19]

Saitoh et al.

[11] Patent Number: 4,982,534

[45] Date of Patent: Jan. 8, 1991

[54] SUSPENDED MEMBRANE STRUCTURE

[75] Inventors: Masao Saitoh, Urawa; Katsuhiko Endo, Tokyo; Yuzo Endoh, Urawa; Takeshi Kuroda, Miyoshi; Makoto Saito, Higashimurayama; Kenzo Shinkubo, Kiyose, all of Japan

[73] Assignee: Mitsui Construction Co., Ltd., Tokyo, Japan

[21] Appl. No.: 354,200

[22] Filed: May 19, 1989

[51] Int. Cl.[5] ..... E04B 1/347; E04C 3/02

[52] U.S. Cl. ..... 52/63; 52/64; 52/82; 52/83; 135/105; 135/DIG. 5; 135/DIG. 8

[58] Field of Search ..... 135/103, 105, DIG. 5, 135/DIG. 8, DIG. 1, 119, 120, 97; 52/66, 82, 64, 83, 63

[56] References Cited

U.S. PATENT DOCUMENTS

| | | | |
|---|---|---|---|
| 1,839,076 | 12/1931 | Adams | 135/105 |
| 2,317,682 | 4/1943 | Geddes | 135/DIG. 8 |
| 2,355,008 | 8/1944 | Moran | 135/87 |
| 2,622,546 | 12/1952 | Kramrisch . | |
| 2,881,718 | 4/1959 | Stromeyer | 52/83 |
| 2,988,096 | 6/1961 | Otto | 135/87 |
| 3,288,158 | 11/1966 | Gugliotta | 52/83 |
| 3,643,391 | 2/1972 | Mollinger | 52/83 |
| 4,578,908 | 4/1986 | Ishler | 135/DIG. 8 |
| 4,736,553 | 4/1988 | Geiger | 135/DIG. 8 |

FOREIGN PATENT DOCUMENTS

| | | | |
|---|---|---|---|
| 1684636 | 5/1971 | Fed. Rep. of Germany . | |
| 436277 | 7/1948 | Italy | 135/97 |

*Primary Examiner*—John E. Murtagh

*Attorney, Agent, or Firm*—Oblon, Spivak, McClelland, Maier & Neustadt

[57] ABSTRACT

A suspended membrane structure, comprising:

a plurality of suspending members arranged substantially parallel or substantially radial fashion;

a membrane downward hung by a plurality of wire members (or hanging members) from a plurality of points on each suspending member; and a plurality of bracing cables each provided on the membrane in the same direction with that of said suspending member at each middle position between said suspending members, and capable of imparting a tensile force to said membrane.

7 Claims, 9 Drawing Sheets

SUSPENDED MEMBRANE STRUCTURE

BACKGROUND OF THE INVENTION

1. Field of the Invention

The present invention relates to a novel suspended membrane structure, suitably usable in constructions with a relatively large span.

2. Description of the Prior Art

The membrane structures presently used in general take the form of an air-supported membrane structure, a suspended membrane structure or a membrane-sheeted frame structure.

The air-supported structure comprises a membrane made to outward swell with a relatively small curvature, in other words, made to have a curved surface with a so-called small rise or arch, where the wind pressure applied to the membrane is allowed to act as a negative pressure as far as possible, so that a well-balanced resistance to wind can be exhibited.

Also, reinforcing cables may be appropriately provided to the membrane, so that it becomes possible to keep a huge span as exemplified by an indoor base ball field.

However, air must be always supplied to maintain the shape of the membrane surface, accompanying a very troublesome management for the maintenance, requiring a considerable expense, and bringing about the problem that this structure is unsuitable from an economical viewpoint when used in constructions of a medium or small span of 100 m or less.

Moreover, because of its inside necessarily constructed to prevent escape of air and to define a closed space, the comfortableness due to the openness or air-freshness can not be expected, also lacking in a sense of the seasons.

Referring to the suspended membrane structure, this has the advantages that the membrane is expected to have a membrane stress resistance inherent in the membrane structure itself, can be readily applied with prestress, and can give a beautiful form, and also has the feature that a large-scale continuous space can be obtained when the suspended membrane structure is of a post type.

However, when the suspended membrane structure of a post type is employed, the post can be an obstruction depending on the use of the structure. Also when it is of a single arch type, there is the problem that an unbalanced tensile force distribution at both sides of the arch may make poor the balance of the arch and make it difficult for a bearing frame to be well self-supported.

FIG. 18 illustrates an example of the above membrane-sheeted frame structure, in which a membrane 3 is spread on the top of a self-supporting frame 1 with a secondary member 2 held therebetween.

This membrane-sheeted frame structure has the features that the frame can be well self-supported and can form a freely curved surface. It also has the advantage that there is no limitation to its plane or sectional configuration, and the structure can be designed with ease.

However, in the instance where the surface formed by the membrane 3 is spread on the grille of the space trussed frame 1 as in the example shown in FIG. 18, the point support system that utilizes the point of a top chord can promise with difficulty a sufficient strength, since the wind pressure applied to the membrane surface is transferred to the frame 1 through the point-supported portions.

Also, in an instance where a system is taken in which the membrane is successively supported along the frame 1, the above secondary member 2 is required in an excessive number so that the membrane surface can keep its shape, thus making it difficult to economically provide frame members.

In addition, the membrane 3 necessarily comes to have an excessively small size and curvature for a structural membrane, and hence can only have the function as a light-transmissive finishing member that covers the top of the frame 1, thus bringing about the problem that the system of the tensile force resistance by virtue of the membrane surface, which should be inherently possessed by the membrane structure, can not be said to have been sufficiently achieved.

Moreover, because of the frame 1 held beneath the membrane 3, only the form of the frame 1 may be emphasized to the persons inside the structure, resulting in a weakening of the beautifulness such as the lightness or comfortableness to be demonstrated by the curved surface of the membrane.

SUMMARY OF THE INVENTION

The present invention was made on account of the above problems conventionally involved, and an object thereof is to provide a novel suspended membrane structure having all the advantages possessed by the above membrane structures.

To achieve the above object, the present invention provides a suspended membrane structure, comprising:

a plurality of suspending members arranged substantially parallel or substantially radial fashion;

a membrane downward hung by means of a plurality of wire members (or hanging members) from a plurality of points on each suspending member; and a plurality of bracing cables each provided on the membrane in the same direction as that of said suspending member at each middle position between said suspending members, and capable of imparting a tensile force to said membrane.

BRIEF DESCRIPTION OF THE DRAWINGS

FIGS. 1 to 10 illustrate an embodiment of the present invention, in which;

FIG. 1 is a perspective illustration of the main part that shows the constituent units of the suspended membrane structure according to the present invention;

FIG. 2 is a plan view of the suspended membrane structure according to the present invention;

FIG. 3 is a side elevation of FIG. 2;

FIG. 4 is a cross section along the ling A—A in FIG. 2;

FIG. 5 is an end elevation to illustrate a plane construction of the membrane;

FIG. 6 is an end elevation to show the state wherein the membrane is opened;

FIG. 7 is a schematic view to show an example of a means for applying tensile force;

FIG. 8 is an enlarged explanatory view of the main part in FIG. 7; and

FIGS. 9 and 10 are views to show how the membrane member is opened or closed.

DESCRIPTION OF THE PREFERRED EMBODIMENTS

Preferred embodiments of the present invention will now be described below with reference to the accompanying drawings.

Figure 1:
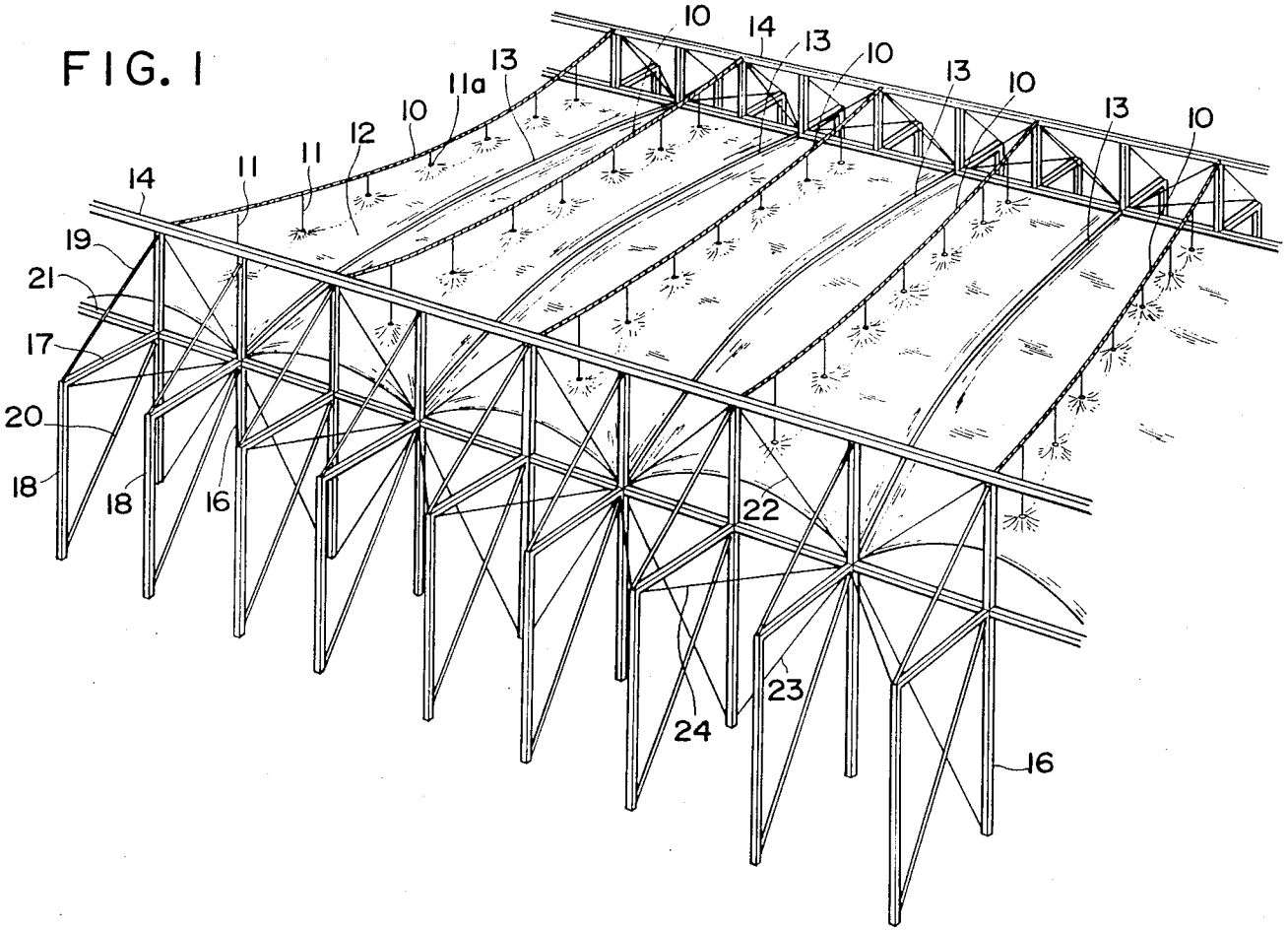
Figure 2:
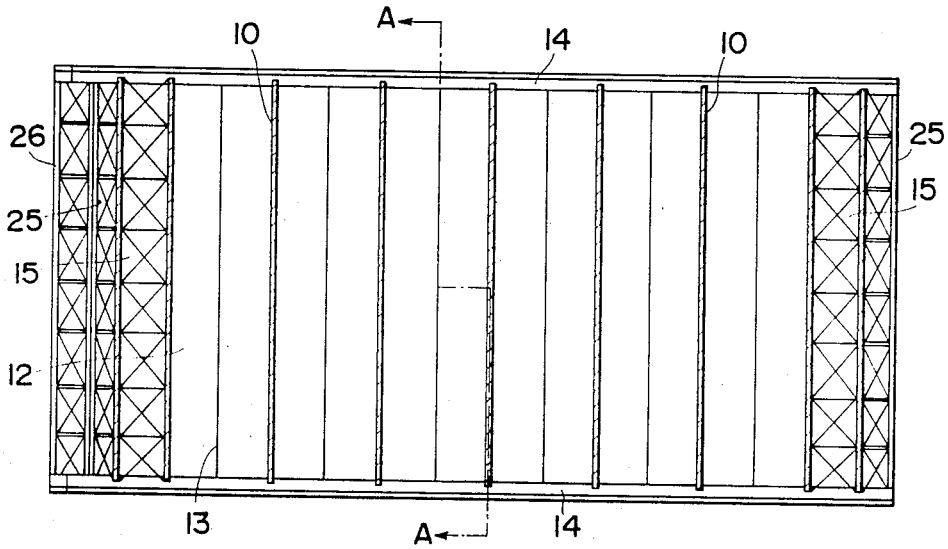
Figure 3:
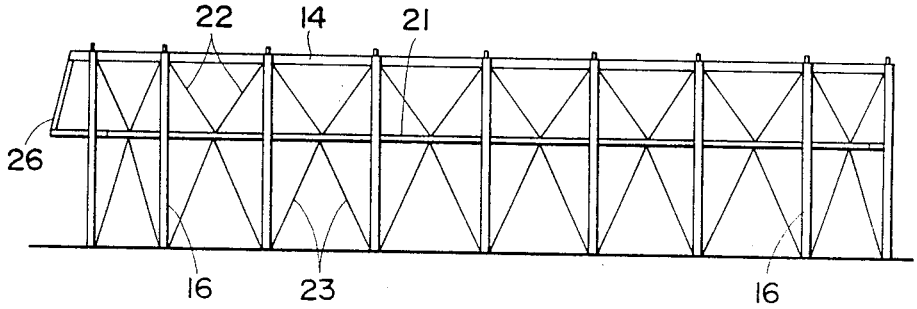
Figure 4:
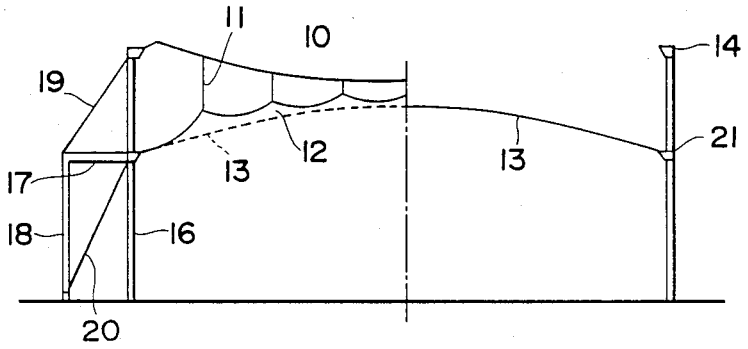
Figure 5:
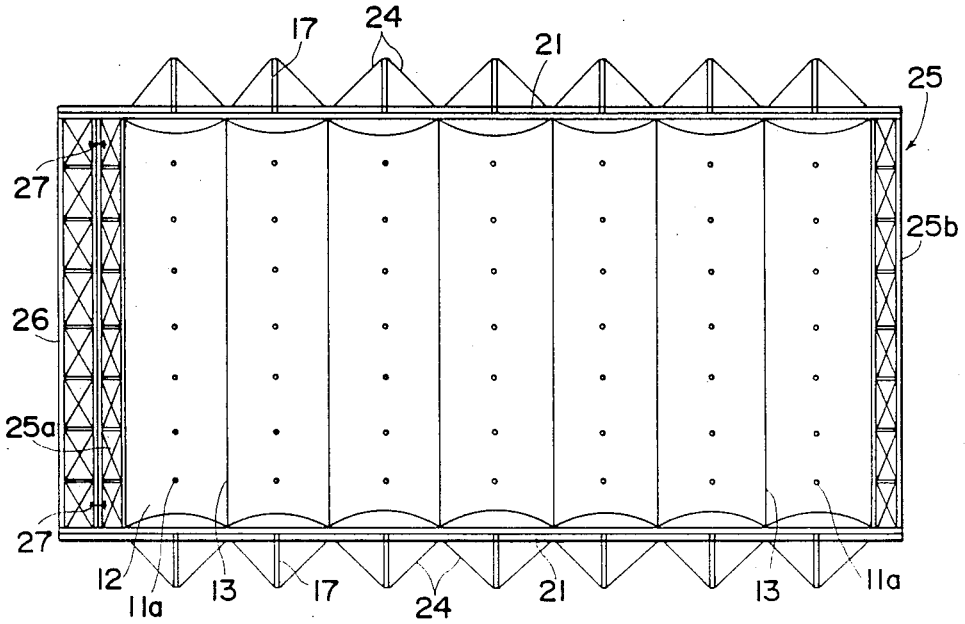

FIGS. 1 to 10 illustrate an embodiment of the present invention, in which FIG. 1 is a perspective illustration of the main part that show the constituent units of the membrane structure according to the present embodiment; FIG. 2 is a plan view of the membrane structure according to the present embodiment; FIG. 3 is a side elevation of FIG. 2; FIG. 4 is a cross section along the ling A—A in FIG. 2; and FIG. 5 is an end elevation to illustrate a plane construction of the membrane.

The suspended membrane structure according to this embodiment comprises, as illustrated in FIG. 1, a suspension cable 10 serving as the suspending member, a tie cable 11 serving as the hanging member, a membrane 12, and a bracing cable 13.

Suspension cables 10 are arranged in a parallel fashion at given intervals, and are each in the form of a downward curved arc as illlustrated in FIGS. 1 and 4.

In the present embodiment, seven struts of the tie cable 11 are downward hung from each suspension cable 10, and the membrane 12 is hung up by the respective tie cables 11 through means of hanging fitments 11*a*.

The bracing cable 13 is provided on the membrane 12 in parallel to the suspension cable 10 at each middle position between said suspension cables 10, and each suspension cable 10 is so made as to be capable of imparting a tensile force necessary for the membrane 12 by the action of a prestress previously applied at its ends as detailed later.

As illustrated in FIGS. 1 and 4, the membrane structure is so constructed that the membrane surface formed by the membrane 12 may maintain enough curvatures between the respective points at which the membrane is supported with the tie cables 11, to give well-balanced curved surfaces, and there can be achieved the system of the tensile force resistance by virtue of the membrane body itself integrally comprised of the membrane 12 and the bracing cable 13.

As the whole membrane surface, it is formed as a curved surface with a small rise, having a small outward swell. Thus, the membrane structure is so constructed that the negative pressure distribution may be obtained on the membrane surface as far as possible when a wind pressure is applied to the membrane.

In FIGS. 1 and 5, the numeral 14 denotes first beams serving as supporting members provided in the longitudinal direction at the both end positions of the suspension cables 10, and 21 denotes second beams serving as supporting members provided in the longitudinal direction at the both end positions of the bracing cables 13.

The numeral 15 denotes truss-like stiffeners that resist the horizontal force, provided at both ends in the longitudinal direction of the structure. In the present embodiment, the stiffener 15 seen on the left side of FIG. 2 is constructed as a driving member movable in the longitudinal direction of the structure (the left and right side directions in the drawing), as detailed later, and, on the other hand, the stiffener 15 on the right side in the drawing is fixed to the first beam 14 at its both ends.

The numeral 16 denotes pillar members provided at the both end positions of the suspension cable 10, and cross bar members 17 and auxillary pillar members 18 are provided in a fashion outward projected from the piller members 16, to which a first reinforcing wire 19 and a second reinforcing wire 20 are each provided to form a truss as illustrated in FIG. 4.

Brace members 22 and 23 are stretched between the upper and lower ends of the piller members 16 and the positions of the second beams 21 at which the both ends of the bracing cables 13 are fixed.

Wires 24 are further stretched, as shown in FIG. 5, between the positions of the second beams 21 at which the both ends of the bracing cables 13 are fixed, and the tips of the above cross bar members 17.

In the present embodiment, the both ends of each respective suspension cable 10 and the both ends of each bracing cable 13 are slidably movable in the longitudinal direction by means of a desired sliding unit, along the supporting members at the both ends (along the above first beams 14 in respect of the suspension cables 10 and the above second beams 21 in respect of the bracing cables 13).

A known suitable unit can be utilized as the sliding unit. For example, rails may be provided along the first beams 14 and the second beams 21 so that rollers provided at the both ends of each suspension cable 10 and the both ends of each bracing cable 13 may be slidably moved in the above rails.

In the present embodiment, the above stiffener 15 provided on the left side viewed in FIG. 2 is slidably moveable at its both ends along the above first beams 14 in the same way as the suspension cables 10, and said movable stiffener 15 is driven as a driving member in the longitudinal direction by means of the desired drive unit, so that the above membrane 12 can be freely opened or closed by spreading or folding it together with each suspension cable 10 and bracing cable 13 as detailed later.

A known suitable unit can be utilized as the above drive unit. For example, racks may be provided along the first beams 14 and pinions that engage with the racks may be provided on the rotating shaft of an electric motor mounted at the ends of the stiffener 15 so that the stiffener 15 can be driven by the rotation of the shaft of the electric motor.

Also, in the present embodiment, as shown in FIG. 5, the both ends in the longitudinal direction, of the above membrane 12 (the direction in which the membrane is opened or closed) are fixed along reinforcing members 25 (25*a* and 25*b*) provided across the span on the same plane as the membrane 12.

The reinforcing members 25 are formed as truss members in the present embodiment so that the reinforcing members 25 can have a given stiffness.

The both ends of the reinforcing member 25*a* (a driving member) positioned beneath the movable stiffener 15 provided on the left side viewed in FIG. 5 are also slidable in the longitudinal directon along the beam 21 like the above bracing cable 13, and the other reinforcing member 25*b* (on the right side in FIG. 5) is fixed on the beam 21 at its both ends.

The movable stiffener 15 and the movable reinforcing member 25*a* beneath it, both serving as driving members, are integrally connected in their upper and lower relationship, so that they can be moved simultaneously.

An appentice member 26 is further provided in the transverse direction at the outside of the above movable reinforcing member 25*a* so that the movable reinforcing member 25*a* and the corresponding position of the appentice member 26 coming into touch therewith can be detachably connected by means of a locking device that can be operated from a position on the ground.

The locking device 27 may be constructed in the manner, for example, that a plurality of movable pins fitted to either one of the reinforcing members 25*a* and appentice member 26 are engaged with corresponding holes provided on the other member, and the movable pins are remote controlled by utilizing air pressure or oil pressure to connect the reinforcing member 25*a* and appentice member 26 or release the connection between them.

The appentice member 26 is also constructed to form a truss on its plane so that it can have a given stiffness.

Figure 7:
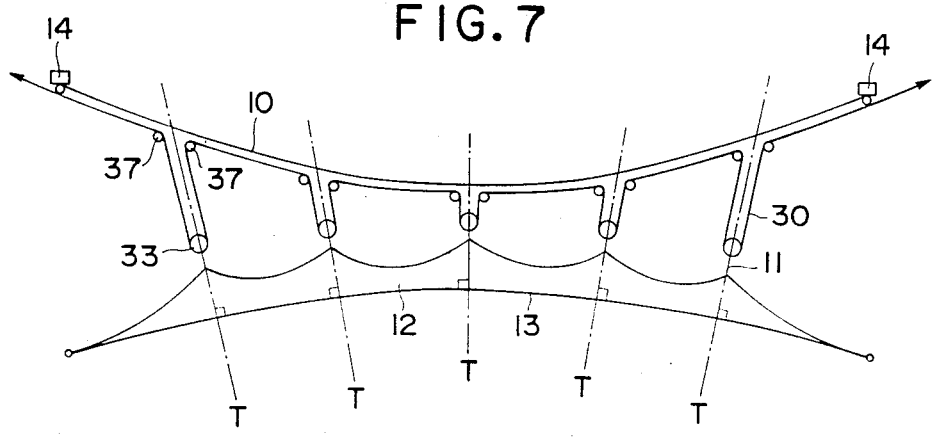
Figure 8:
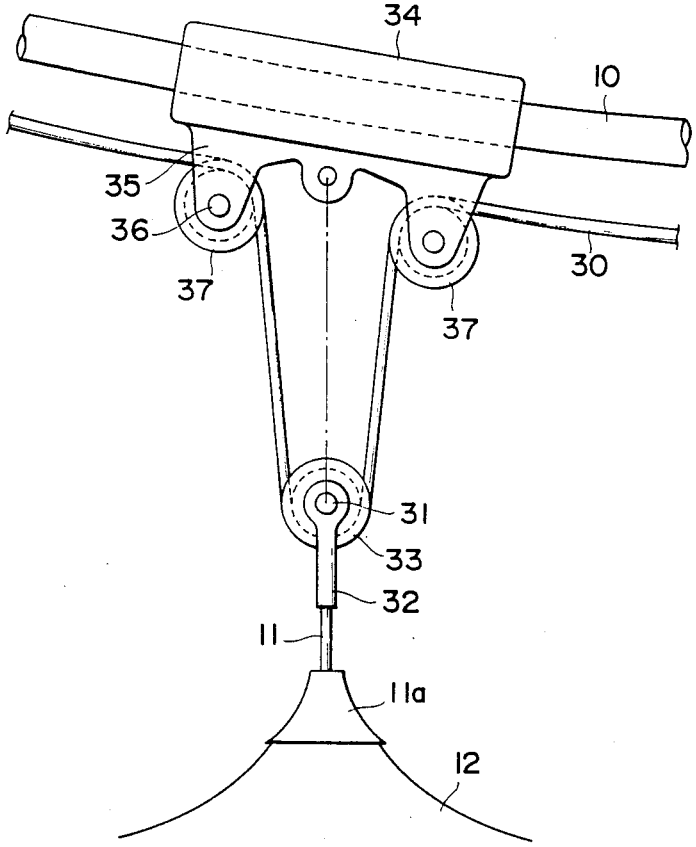
Figure 18:
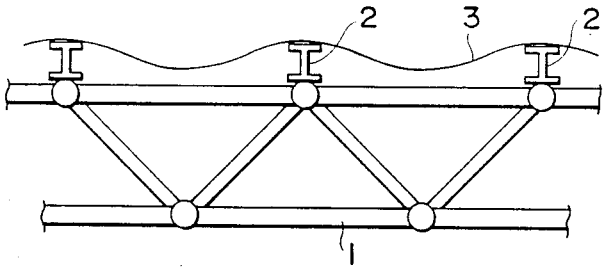
FIG. 18 schematically illustrates an example of a conventional membrane-sheeted frame structure.

In the present embodiment, there is further provided with a means for applying tensile force to the membrane 12 as illustrated in FIGS. 7 and 8.

More specifically, a length of continuous wire 30 such as a wire rope is stretched along the suspension cable 10, and a pulley 33 is rotatably provided at the upper end of each of the above tie cables 11 through a rotating shaft 31 and a shaft support rod 32.

Holding members 34 are also each fixed on the suspension cable 10 at the position right above the tie cable 11, and a pair of second pulleys 37 are rotatably provided to each of said holding members 34 through means of a pair of bearing plates integrally formed therewith and a rotating shaft 36.

The above wire 30 is downward extended at the position of each tie cable 11 after it has been engaged with one of the above second pulleys 37 as shown in FIG. 8 and successively upward extended to be engaged with the other of the second pulleys 37 through the above first pulley 33. The ends of each wire 30 are connected to given wind-up units (not shown) provided on the both ends of the above suspension cable 10.

When the wire is wound up and the membrane 12 are tensed by the wind-up unit, the bracing cable 13 described above is so constructed as to form an upward curved arc as shown in FIG. 7. In the present embodiment, the positions at which the tie cables 11 are attached are so set that when the wire is wound-up, the above tie cables 11 are provided extending in the direction of their respective normal lines with respect to the above bracing cable 13 formed in an arc.

More specifically, as is seen in FIG. 7, the positions at which the tie cables 11 hang the membrane 12 and the positions at which the above holding members 34 provided on the upper elongation lines of the imaginary elongation lines T of the respective tie cables 11 are fixed to the suspension cable 10 are previously so set that the imaginary elongation lines T of the tie cables 11 may respectively cross at right angles to the curved line of the bracing cable 13 when the wire is wound up.

The wind-up unit may be constructed, for example, such that it comprises a reversibly rotatable motor and a wind-up drum coaxially provided along the rotating shaft of the motor, the ends of the above wire 30 are connected to the winding surface of a wind-up drum, and the motor is remote-controllable from a position on the ground.

Thus, as illustrated in FIG. 7, the above wire 30 may be wound up with the above wind-up unit in the direction as shown by the arrows in the drawing and thereby the wire 30 simultaneously upward draw the respective tie cables 11 by respectively given distances through the first pulley 33, so that the tensile force is imparted to the suspension cable 10 and bracing cable 13 and hence a given tensile force can be applied to the membrane 12.

When the membrane 12 is brought into the state of being opened, the tension of the respective suspension cables 10 and bracing cables 13 are required to be removed to loosen the membrane 12 and thereafter the suspension cables 10 and bracing cables 13 are moved to the given directions together with the membrane 12.

Here, the above wind-up unit may be driven in reverse to the above wind-up motion, so that the respective tie cables 11 downward move by virtue of the gravity of the membrane 12, bracing cables 13, etc., the tension of the respective suspension cables 10 and bracing cables 13 is removed, and thus the membrane 12 can be loosened.

In the case when the membrane 12 is again brought into a close state from the above open state, the tensile force may be imparted to the membrane 12 in the same manner as the case when the tensile force is initially applied as described above.

In the suspended membrane structure according to the present invention, constructed as described above, the membrane 12 can be brought into the open state in the following manner: First, the above wind-up unit is driven to wind off the wire to remove the tensile force of the suspension cables 10 and bracing cables 13 and also the tensile force of the membrane 12 is kept loose. At the same time, the above locking device 27 is operated to beforehand unlock the engagement to separate the above movable reinforcing member 25*a* from the above appentice member 26.

Thereafter, the above drive unit is operated, so that the movable stiffener 15 located on the left end viewed in FIG. 2 is moved toward the other end in the longitudinal direction together with the movable reinforcing member 25*a* provided beneath it.

The above movable stiffener 15 is moved to a predetermined position before it reaches the position at which the suspension cable 10 contiguous thereto is stretched, and press this suspension cable 10, so that this suspension cable 10 equipped with the sliding means is also moved in the longitudinal direction together with the stiffener 15. Similarly, the respective bracing cables 13 are moved in the longitudinal direction along the movement of the movable reinforcing member 25*a*.

Subsequently, synchronous to the movement of the stiffener 15, the membrane 12, while being folded to a certain extent, is also moved together with the tie cables 11 and bracing cables 13, to the other end portion in the longitudinal direction.

Figure 9:
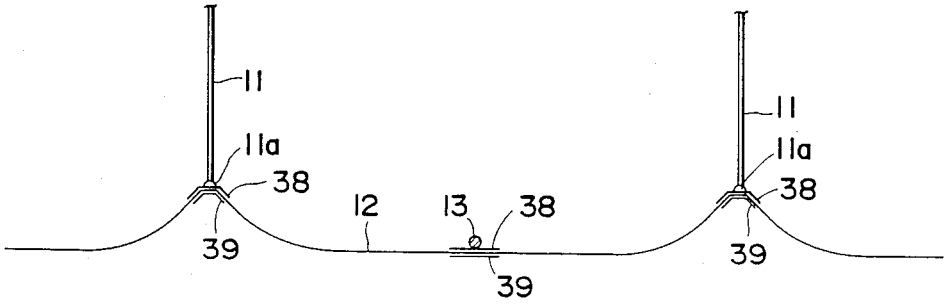
Figure 10:
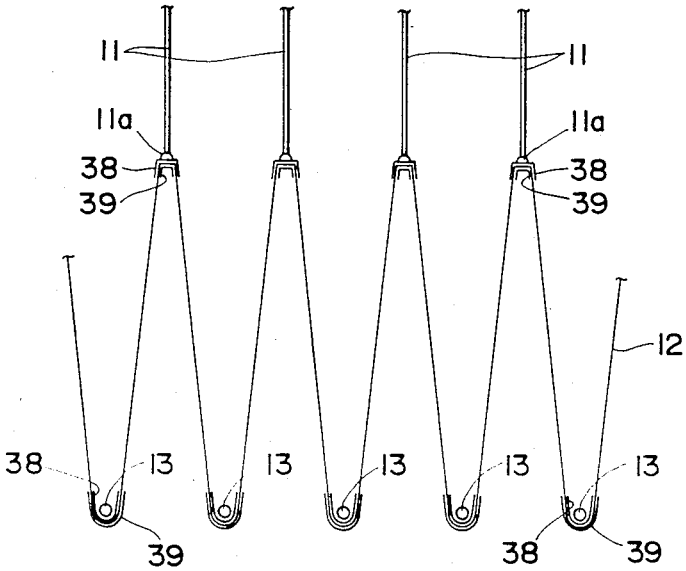

More specifically, the membrane 12 is brought from the close state as illustrated in FIG. 9 into the gradually folded state as illustrated in FIG. 10.

In the present embodiment, as illustrated in FIGS. 9 and 10, a ribbon-like surface reinforcing sheet 38 and a similar back reinforcing sheet 39 are continuously sealed in the transverse direction of the structure, to the surface and back of the membrane 12 along each position at which the tie cable 11 is joined at its lower end to the membrane 12.

Another ribbon-like surface reinforcing sheet 38 and another similar back reinforcing sheet 39 are also continuously sealed in the transverse direction of the structure, to the surface and back of the membrane 12 along each position at which the above bracing cable 13 is stretched. Thus, the membrane 12, to which the folding stress is applied many times when it is opened or closed, can be effectively reinforced.

Figure 6:
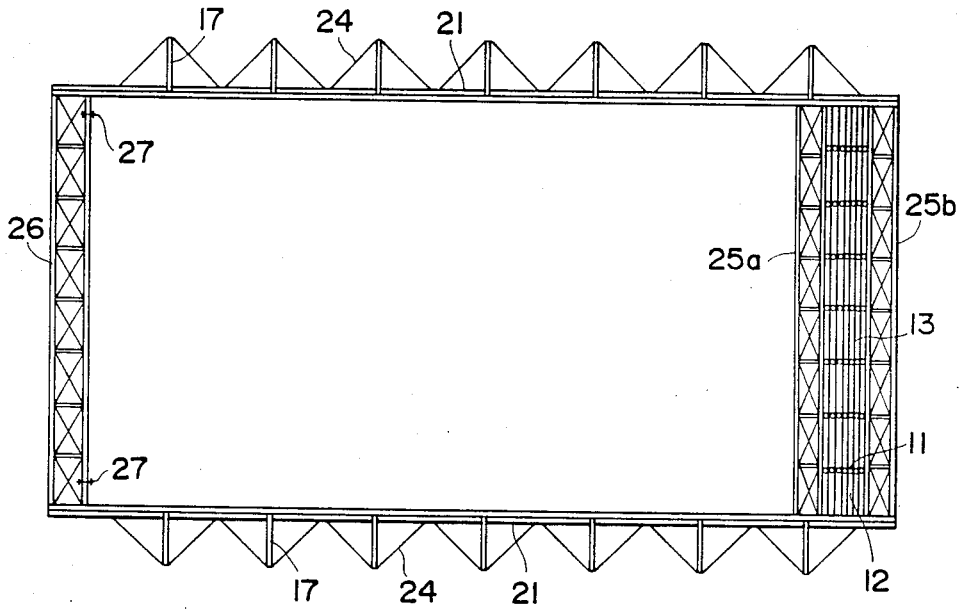

When the membrane 12 is completely moved in the longitudinal direction to the other end mentioned above, it can be brought into the intended open state as illustrated in FIG. 6.

In order to bring the membrane 12 into the close state from the open state, the procedures in the reverse order to the above procedures may be taken to drive back the movable stiffener 15 to the original position. The movable reinforcing member 25*a* returned synchronous therewith to the original position together with the membrane 12 as shown in FIG. 5 is brought into the state wherein it is again connected to the appentice member 26 by the operation of the locking device 27.

Thereafter, the wind-up unit provided at the both ends of each suspension cable 10 may be driven to again apply the given tensile force to the membrane 12.

In the suspended membrane structure according to the present embodiment, constructed as described above, the wind pressure that may be applied as a main load mostly acts on the membrane surface as the negative pressure, so that the membrane 12 and bracing cables 13 bear said negative pressure as the tensile force, and the resulting stress is absorbed by the flexible membrane 12 and bracing cables 13 even when, for example, an unbalanced stress is produced accompanying the deformation of membrane surface due to a wind pressure locally applied.

Hence, only the wind pressure at the part a positive pressure distribution is more or less applied to the suspension cable 10 may act as the short-time or temporary loading through the tie cable 11.

The conventional membrane-sheeted frame structure previously described has been constructed by spreading the membrane over the top of the frame, so that the frame must finally bear all the wind pressure, regardless of the positive pressure or negative pressure, and hence the frame is required to comprise a large cross-section member strong enough to endure the pressure, resulting in complicated joins between frame members. However, in the present embodiment, the suspension cables 10 may only support the very lightweight, long-time self loading from the suspension cables 10, membrane 12, bracing cables 13 and so forth, as well as a certain degree of a temporary loading from wind pressure and snow fall.

Materials with flexibility are used in wires or cables in the suspended membrane structure of the present invention, and hence the load applied through the tie cables 11 acts on the suspension cables 10 only as axial force and no bending force acts thereon at all, so that the structure can be made remarkably lightweight as compared with the above prior art in which the frame members with high rigidity are used.

The bracing cables 13 also function as a large resistance factor against the wind pressure, and hence there can be provided a very rational structure.

The membrane 12 is also submitted to point supports by the suspension cables 10 with respect to a small load, and submitted to linear support by the bracing cables 13 with respect to a large load, as described above, and thus the joins are formed in a rational state to accord with the magnitude of the load.

The membrane 12 is also hung from the suspension cables 10 in point suspension with a minimum number, and therefore the details for waterproofing can be simplified.

The membrane 12 also has the form in which it is apparently separated from the suspension cables 10 through the tie cables 11, so that the appearance of the structure can give an impression of a systematic design by virtue of the suspension cables 10, and on the other hand when the structure is looked up from its inside, the membrane surface with sufficient curvature is seen to be provided over the ceiling, and hence the soft and attractive atmosphere inherent in the membrane itself can be given as in the conventional suspended membrane structures or air-supported membrane structures.

The membrane structure is also provided with the membrane with its surface positioned beneath the suspension cables 10, so that the erection of framing (the attachment of the membrane 12 to the suspension cables 10) can be carried out with ease as compared with the conventional membrane-sheeted frame structures.

When the membrane surface has been creeped with years and must be again tensed, this can be easily done at the peripheral area of the membrane following the same procedures as those for applying the initial prestress as previously described.

In the present embodiment, the both ends in the longitudinal direction, of the membrane 12 are fixed to the reinforcing members 25, and said reinforcing members 25 themselves have a given rigidity, so that the reinforcing members 25 can withstand the tension load that acts in the longitudinal direction when the tensile force is applied to the membrane 12 by means of the tension unit described above.

As a result, a sufficient tensile force can be imparted to the membrane 12 not only in the transverse direction but also in the longitudinal direction (the direction in which the membrane 12 is opened or closed), without causing any harmful deformation in the membrane 12.

The wind-up unit that utilizes the wire 30 and pulleys makes it possible to carry out the application of tensile force to the membrane 12 in a short time and good efficiency.

The membrane structure is also constructed in the manner that, when tensed, the tie cables 11 are provided extending in the direction of their respective normal lines with respect to the above bracing cable 13 formed in an arc, so that the hang-up force applied to the membrane 12 from each tie cable 11 acts to be focused on the center of the circle imaginarily formed by the arc-like bracing cable 13, making higher the dynamic balance when the tensile force is applied to the membrane 12.

Figure 11:
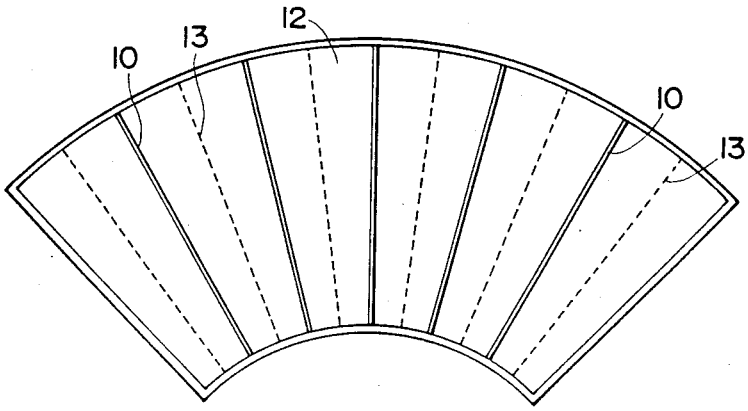
FIGS. 11 to 17 each schematically illustrate other embodiments of the present invention.
Figure 12:
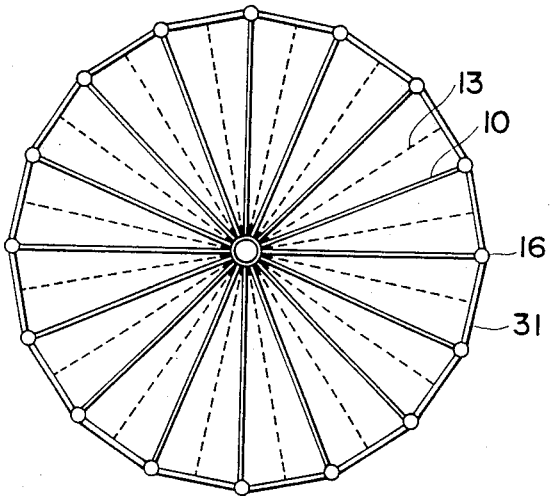
Figure 13:
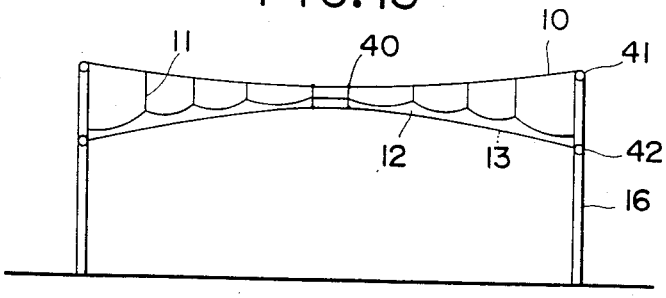

In the above embodiment, described is an example in which the respective suspension cables 10 are arranged in parallel each other. Besides this, however, it is also possible to arrange the suspension cables 10 in substantially a radial fashion each other, as illustrated in FIG. 11 and FIG. 12 or 13. In this instance, the press cables 13 may be provided in the middle positions between the respective suspension cables 10 and in the same direction as the suspension cables 10.

In the embodiment illustrated in FIGS. 12 and 13, a center ring 40 is provided at the center, and the respective ends at the center side of the suspension cables 10 and bracing cables 13 are connected to the center ring 40.

In this embodiment, the membrane structure is constructed such that the respective ends at the periphery side of the suspension cables 10 and bracing cables 13 are connected to a first compressive ring 41 and a second compressive ring 42, respectively, in place of the first reinforcing wire 19 and second reinforcing wire 20 shown in the above first embodiment, where the compressive strength of the respective compressive rings 41 and 42 can keep the balance to the tension load applied from the respective suspension cables 10 and bracing cables 13.

Namely, in the present embodiment, endless compressive rings 41 and 42 are utilized by making the most of the feature that the membrane structure is a plane, round construction.

Also in the present embodiment, the same external back-stay members as used in the previous embodiment may be utilized in place of the compressive rings.

FIGS. 14 to 17 illustrate other embodiments of the suspended membrane structure of the present invention. For convenience, only roofs of the structures are shown in these figures, with omission of the lower part structural members.

Figure 14:
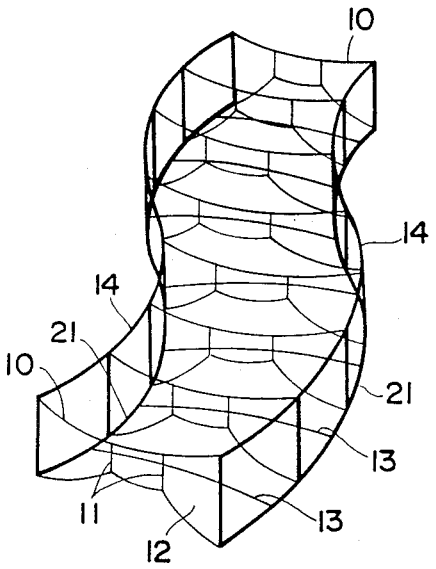

In the embodiment of FIG. 14, pairs of first beams 14 and second beams 21 to slidably support the both ends of the respective suspension cables 10 and bracing cables 13 are respectively formed in a curved line fashion, and at the same time arranged in parallel, keeping each other given intervals.

Figure 15:
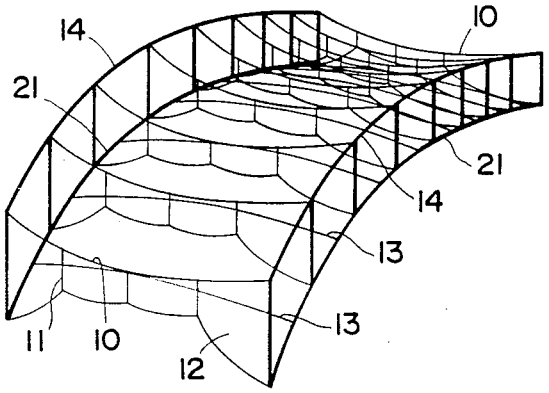

In the embodiment of FIG. 15, pairs of first beams 14 and second beams 21 are formed in an upward curved arc and at the same time arranged in parallel, keeping each other given intervals.

Figure 16:
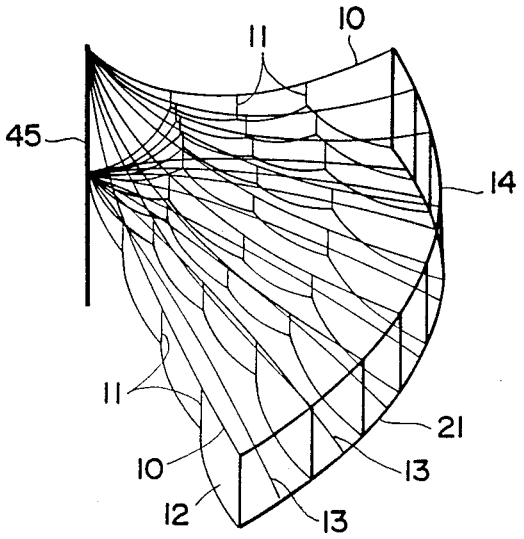

In the embodiment of FIG. 16, one ends of the respective suspension cables 10 and bracing cables 13 are convergently supported on a pole 45, and the other ends of the respective suspension cables 10 and bracing cables 13 are slidably supported on a first beam 14 and a second beam 21, respectively, formed in a horizontally outward curved arc.

Figure 17:
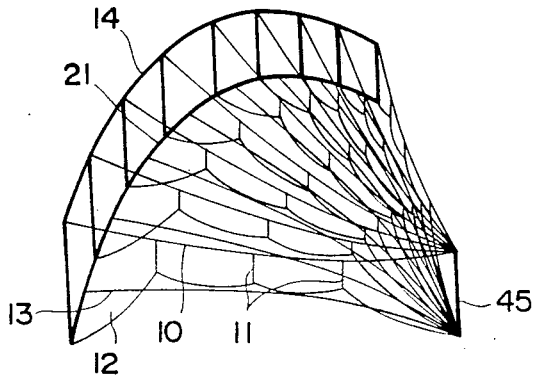

In the embodiment of FIG. 17, one ends of the respective suspension cables 10 and bracing cables 13 are convergently supported on a pole 45, and the other ends of the respective suspension cables 10 and bracing cables 13 are slidably supported on a first beam 14 and a second beam 21, respectively, formed in an upward curved arc.

In the above embodiments, shown are examples in which the stiffeners 15 in the first embodiment were made to comprise driving members, but the same operational effect can be obtained also when the drive unit previously described is mounted on the side of the movable reinforcing member 25*a*.

The movable reinforcing member 25*a* and appentice member 26 previously described may also be arranged by upward and downward positioning them with different height so that the movable reinforcing member 25*a* and appentice member 26 may be connected by means of the locking device 27 at the position where they are above and below overlapped one another. In this case, it follows that the appentice member 26 does not protrude outwardly.

Besides the embodiment in which the wire 30 previously described is provided with the wind-up unit at its both ends as in the above, the wind-up system may also be constructed such that a pulley to turn back the wire 30 is provided at one end of each suspension cable 10 and the wind-up unit is operated to wind up the wire from only the other end thereof through another third pulley.

It is also possible to use lightweight beams such as single steel members in place of the suspension cables 10.

The present invention is by no means limited to the above embodiments, and it is needless to say that variously modified embodiments are possible so long as they are not out of the gist of the present invention; for example, it is possible to appropriately modify, depending on disign conditions, the intervals between the suspension cables 10, the span, the number of tie cables to be provided, etc.

The present invention is constructed as described in the above, and comprises a plurality of suspending members arranged substantially parallel or substantially radial fashion, a membrane downward hung by means of a plurality of wire members (or hanging members) from a plurality of points on each suspending member, and a plurality of bracing cables each provided on the membrane in the same direction with that of said suspending member at each middle position between said suspending members and capable of imparting a tensile force to said membrane. Hence, the resistance to wind as a lightweight structure can be expected to be given to the membrane body comprised of the membrane and bracing cables, and the resistance to external force, attributable to the tensile force of the membrane body, which should be inherent in the membrane structure, can be well exhibited.

Also, the load applied from the lower part entirely acts on the suspending members only as axial force and no bending force acts thereon at all, so that the structure can be made to have a rational structure form, and the whole structure can be made lightweight as compared with the above prior art in which the frame members with high rigidity are used.

In instances in which the membrane structure is used, in particular, as sporting installations or the like, the membrane capable of being opened or closed makes it possible to keep the openess of a comfortable space in accordance with the weather.

What is claimed is:

1. A suspended membrane structure comprising:

a plurality of suspending members each having ends and arranged in substantially parallel or substantially radial fashion, a prestress being applied to each of said plurality of suspending membranes at respective ends thereof;

a membrane suspended beneath said plurality of suspending members and forming a membrane surface;

a plurality of tie cables for attaching the membrane at a support point to each of the plurality of suspending members in a point support fashion from a plurality of points on each suspending member; and a plurality of bracing cables each having ends and each being provided on the membrane in a same direction as that of said suspending member at each middle position between adjacent suspending members, and capable of imparting a tensile force to said membrane;

wherein said membrane sags between respective support points at which said membrane is attached to said tie cables to form substantially conical peaks at each of the respective support points, and the membrane surface as a whole is formed as a curved surface with a small rise having a small outward swell; and wherein said plurality of suspending members are slidable along first beams provided at respective ends of said plurality of suspending members, and said plurality of bracing cables are slidable along second beams provided at respective ends of said plurality of bracing cables, and a driving member, with a given stiffness, provided at one of said first beams and said second beams and slidable there-along is moved by a given drive unit, thereby making said membrane capable of being opened or closed together with said plurality of suspending member and said plurality of bracing cables.

2. The suspended membrane structure according to claim 1, wherein said driving member is provided at said first beams, and one end of said membrane, in the longitudinal direction thereof, is fixed along a movable reinforcing member provided across said second beams, an appentice member being provided on an outside of and substantially in parallel to said movable reinforcing member, and said movable reinforcing member and said appentice member are detachably connected to one another.

3. The suspended membrane structure according to claim 1, wherein a length of continuous wire is stretched along said suspending member, a first pulley is provided at the upper end of each of said hanging members, a pair of second pulleys connected to each of said suspending members are provided at the position right above each of said hanging members, said wire is successively extended from one of said second pulleys so as to be engaged with the other of said second pulleys through said first pulley, and the ends of said wire are connected to a wind-up unit or units provided on the one end or both ends of each of said suspending members, where said wire is wound up with said wind-up unit to simultaneously upward draw said hanging members by respectively given distances, thereby applying a tensile force to said membrane, or said wind-up unit is reversely operated, thereby releasing the tensile force of said membrane.

4. The suspended membrane structure according to claim 2, wherein said movable reinforcing member and said appentice member are offset vertically and overlap one another so that said movable reinforcing member and said appentice member are connected detachably by a locking device at a position where each overlap one other.

5. The suspended membrane structure according to claim 3, wherein the positions at which said tie cables are attached are so set that when said wire is wound-up, each of the said tie cables are provided with a longitudinal axis extending substantially perpendicular to an associated bracing cable.

6. The suspended membrane according to claim 5, wherein said plurality of bracing cables each form an upwardly bowed arc when said wire is wound-up.

7. The suspended membrane structure according to claim 1, wherein said given thickness of said driving member is sufficient to move at least one of said plurality of suspension members and said plurality of bracing members slidably along said first and second beams respectively.

* * * * *